United States Patent [19]

Kitamura et al.

[11] 4,368,366

[45] Jan. 11, 1983

[54] PNEUMATICALLY OPERATED DEVICE WITH VALVE AND SWITCH MECHANISMS

[75] Inventors: Kazuhiko Kitamura; Takao Nonoyama; Atsuo Okumura, all of Toyota, Japan

[73] Assignees: Aisin Seiki Kabushiki Kaisha, Toyota; Toyota Jidosha Kogyo Kabushiki Kaisha, Kariya, both of Japan

[21] Appl. No.: 223,155

[22] Filed: Jan. 7, 1981

[30] Foreign Application Priority Data

Jan. 23, 1980 [JP] Japan ..... 55-6579

[51] Int. Cl.[3] ..... H01H 35/34

[52] U.S. Cl. ..... 200/83 Q; 200/83 J; 200/83 L

[58] Field of Search ..... 123/568; 137/DIG. 8; 251/61.4; 200/82 R, 82 D, 82 E, 83 R, 83 Q, 83 J, 83 L, 83 S, 83 SA, 83 Y

[56] References Cited

U.S. PATENT DOCUMENTS 3,639,898 2/1972 Booth ..... 200/83 Q
4,191,143 3/1980 Yuuki ..... 123/117 A
4,219,710 8/1980 Booth ..... 200/83 Q
4,235,207 11/1980 Nishimura ..... 123/568
4,266,517 5/1981 Sakakibara ..... 200/83 L

FOREIGN PATENT DOCUMENTS 950957 3/1964 United Kingdom ..... 200/83 L

*Primary Examiner*—G. P. Tolin
*Attorney, Agent, or Firm*—Oblon, Fisher, Spivak, McClelland & Maier

[57] ABSTRACT

A pneumatically operated device responsive to a signal pressure applied thereto from a source of negative pressure for controlling the atmospheric air applied to a control device and for controlling an electric signal applied to an electric control circuit. The pneumatically operated device includes a diaphragm assembly assembled within a housing to subdivide the interior of the housing into first and second chambers respectively in open communication with the negative pressure source and the atmospheric air, and valve and switch mechanisms arranged within the housing to be operated in response to movement of the diaphragm assembly caused by the pressure difference between the first and second chambers.

11 Claims, 2 Drawing Figures

PNEUMATICALLY OPERATED DEVICE WITH VALVE AND SWITCH MECHANISMS

BACKGROUND OF THE INVENTION

The present invention relates to a pneumatically operated device, and more particularly to a pneumatically operated device in which valve and switch mechanisms are arranged to be operated in response to a pneumatic pressure applied thereto.

In a conventional exhaust gas recirculation system for automotive vehicles, various pneumatically operated valve and switch mechanisms have been proposed heretofore. For example, such a pneumatically operated valve mechanism has been adapted to control exhaust gas recirculation in accordance with operating condition of a vehicle engine so as to effect reduction of the nitrogen oxide content $NO_x$ of exhaust emission, while such a pneumatically operated switch mechanism has been adapted to energize a solenoid valve in response to an input signal from an $O_2$ sensor in the exhaust system for controlling the ratio of air-fuel mixture. However, the above valve and switch mechanisms have been independently constructed and arranged in each control system. This results in high production cost of the respective mechanisms and complicated arrangement of them in a limited space.

SUMMARY OF THE INVENTION

It is, therefore, a primary object of the present invention to provide a pneumatically operated device in which valve and switch mechanisms are assembled in a simple and light weight construction to eliminate the disadvantages described above.

Another object of the present invention is to provide a pneumatically operated device, having the above-mentioned characteristics, capable of adjusting the operation timing of the valve and switch mechanisms in a simple manner.

According to the present invention briefly summarized, the above objects are accomplished by provision of a pneumatically operated device responsive to a signal pressure applied thereto from a source of pneumatic pressure for controlling the atmospheric air applied to a control device and for controlling an electric signal applied to an electric control circuit, which device comprises a housing provided with a first inlet port for connection to the pneumatic pressure source, a second inlet port in open communication with the atmospheric air, and an outlet port for connection to said control device; a diaphragm assembly assembled within the housing in a fluid tight manner to subdivide the interior of the housing into first and second chambers respectively in open communication with the first and second inlet ports, the diaphragm assembly being integrally provided with a movable member which is moved by the pressure difference between the first and second chambers; valve means including a valve seat arranged within the second chamber to permit the flow of atmospheric air from the second inlet port to the outlet port, and a valve member cooperating with the movable member to open and close the valve seat in response to the movement of the diaphragm assembly; and switch means arranged within the housing to be connected to the electric control circuit and including a pair of contacts one of which is arranged to be operated in response to the movement of the diaphragm assembly.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENTS

Figure 1:
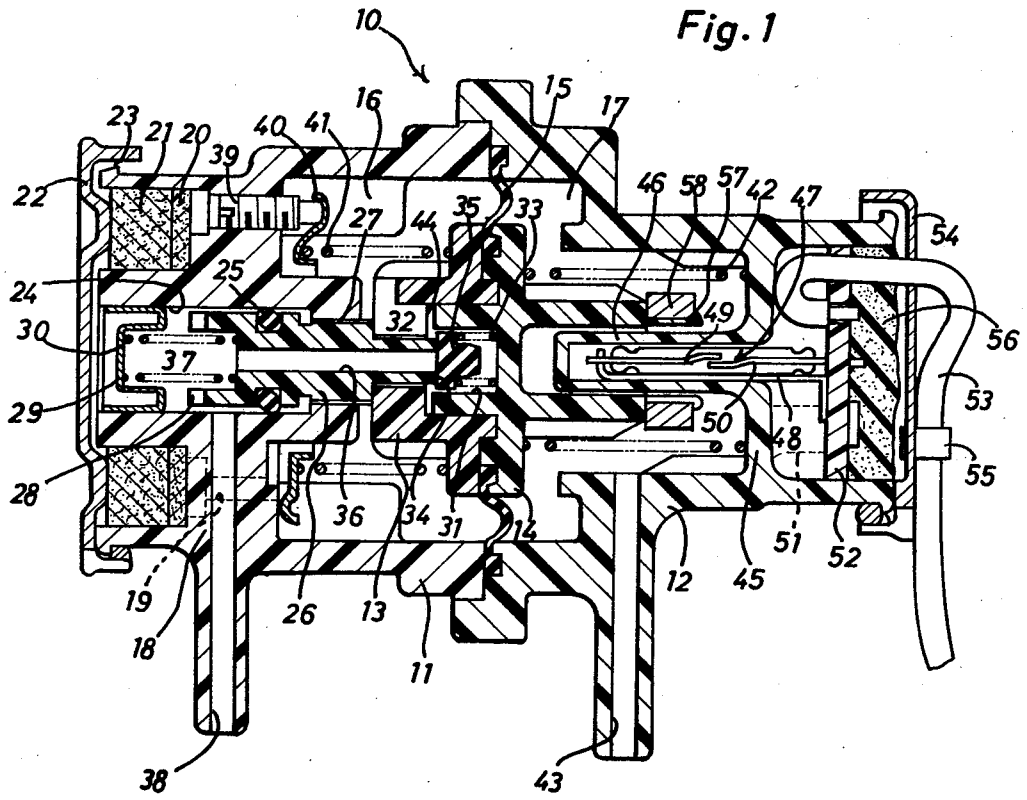
FIG. 1 is a view of an elevational cross-section of a pneumatically operated device in accordance with the present invention.

With reference to FIG. 1 of the drawings, a pneumatically operated device 10 according to the present invention includes first and second housing sections 11 and 12 of synthetic resin which are secured to each other in a fluid tight manner. Between the housing sections 11 and 12 a diaphragm member 15 is interposed and clamped at its outer periphery to subdivide the interior of the housing assembly into an atmospheric chamber 16 and a negative pressure chamber 17. The diaphragm member 15 has a pair of movable members 13 and 14 of synthetic resin which are integrally secured to the central portion of diaphragm member 15. The first housing section 11 is formed in its end wall 18 with an air passage 19 and provided in its recessed portions with a pair of annular air filters 20, 21 which are held in position by means of a cap member 22 of synthetic resin. The cap member 22 is fixedly coupled over the opening end of housing section 11 and forms an air passage 23 which acts as an inlet port. With this arrangement, the atmospheric chamber 16 is in open communication with the atmospheric air through the air passage 19, filters 20, 21 and air passage 23.

The end wall of housing section 11 is formed at its central portion with a stepped axial bore 24 in which a valve seat member 26 of synthetic resin is assembled via an O-ring seal member 25. The valve seat member 26 has a screw portion 27 which is adjustably threaded into the stepped portion of axial bore 24. The position of valve seat member 26 can be adjusted to a desired position by a tool which is engaged with radial recesses 28 formed on the outer end of valve seat member 26. A retainer plug 29 is fixedly engaged within the opening end of axial bore 24, and a compression coil spring 30 is interposed between the plug 29 and the valve seat member 26 to eliminate an intervening space at the threaded portion 27 of valve seat member 26. The inner end of valve seat member 26 is formed as a valve seat 34 and extends into a recessed portion 31 of second movable member 14 through first movable member 13.

The first movable member 13 is formed with an air passage 32 and slidably receives the inner end of valve seat member 26. The recessed portion 31 of second movable member 14 communicates with the atmospheric chamber 16 through the air passage 32 of first movable member 13 and contains therein an elastic valve member 35 which is biased by a weak coil spring 33 to normally engage the valve seat 34 of member 26. Thus, the interior of recessed portion 31 of second movable member 14 is normally isolated from an axial air passage 36 in valve seat member 26, while the interior 37 of axial bore 24 is in open communication with the axial air passage 36 and an outlet port 38 radially formed in the end wall 18 of housing section 11. Within the atmospheric chamber 16 a coil spring 41 is interposed between the first movable member and an annular retainer 40 to bias the diaphragm assembly rightwards. The retainer 40 is received by a screw 39 which is adjustably threaded into the end wall 18 of housing section 11 to adjust the biasing force of spring 41. Within the negative pressure chamber 17 a coil spring 42 is interposed between the second movable member 14 and the inner wall of housing section 12 to bias the diaphragm assembly leftwards. The biasing force of coil spring 42 is determined in a value larger than that of coil spring 41 such that the initial position of the diaphragm assembly is balanced as shown in the figure.

The housing section 12 is formed with an inlet port 43 which is arranged to connect an intake manifold of a vehicle engine. The negative pressure chamber 17 is supplied with a negative pressure through inlet port 43 in accordance with operating condition of the engine. When the negative pressure chamber 17 is supplied with a predetermined negative pressure, the diaphragm assembly moves rightwards against the biasing force of spring 42 and, in turn, the valve member 35 is separated from the valve seat 34 by engagement with an inner shoulder 44 of first movable member 13 to communicate the atmospheric chamber 16 with the outlet port 38 through air passage 36. In such a manner as described above, the valve member 35 cooperates with the valve seat 34 to provide a valve mechanism.

In the valve mechanism, when the biasing force of coil spring 41 is adjusted by screw 39, the biasing force of coil spring 42 is adjusted in relation to the adjusted biasing force of coil spring 41. This serves to adjust the negative pressure value in chamber 17 necessary for conducting rightward movement of the diaphragm assembly. When the position of valve seat member 26 is adjusted to a desired position, as previously described, the distance between the inner shoulder 44 of first movable member 13 and the valve member 35 is appropriately adjusted. This serves to adjust the negative pressure value in chamber 17 necessary for opening the valve mechanism. In addition, the adjustment of the negative pressure value serves to adjust the operating pressure of a switch mechanism described hereinafter. The outlet port 38 is arranged to connect a negative pressure circuit of a control valve for controlling exhaust gas recirculation from the engine.

The switch mechanism includes a reed switch 47 which is assembled within a tubular extension 46 integral with the end wall 45 of second housing section 12. The reed switch 47 comprises a pair of reed contacts 49 and 50, the former being supported by an inner end of a conductor 48, and the latter being fixed to an insulation plate 52. The insulation plate 52 is secured to a projection 51 extending outwardly from the end wall 45 of housing section 12, and the conductor 48 is fixed at its outer end to the insulation plate 52. The reed contact 50 and conductor 48 are connected to a source of electricity by means of lead wires. In the figure, one of the lead wires is illustrated by the reference numeral 53. The lead wires are preferably attached at 55 to a cover member 54 fixed to the outer end of housing section 12, and the insulation plate 52 is fixed in place through a seal member 56 of silicone rubber.

The second movable member 14 is integrally formed with a tubular extension 57 which surrounds the tubular extension 46 of housing section 12. An annular permanent magnet 58 is fixed to the tubular extension 57 in such a manner that the reed contacts 49 and 50 are separated from each other due to the magnetic flux of magnet 58. When the magnet 58 is displaced in a predetermined distance due to rightward movement of the diaphragm assembly, the reed contacts 49 and 50 are engaged to each other to close the switch mechanism 47. In the actual use of the device 10, the switch mechanism is adapted to operate a solenoid valve for controlling the ratio of air-fuel mixture supplied into the engine.

From the above description, it will be understood that adjustment of the biasing force of spring 42 is caused by adjustment of the biasing force of spring 41 and results in adjustment of the negative pressure value necessary for conducting the rightward movement of the diaphragm assembly. This means that the adjustment of the biasing force of spring 42 results in adjustment of the operation timing of reed switch 47.

Hereinafter, the operation of the pneumatically operated device 10 will be described. When the negative pressure in chamber 17 applied from the intake manifold is below a predetermined value, the first movable member 13 is engaged at its left end with an inner shoulder of valve seat member 26 due to the biasing force of spring 42 to normally close the valve mechanism and to normally open the switch mechanism, as shown in the figure. Under the inoperative condition, the valve member 35 abuts against the valve seat 34 by the resilient force of spring 33 to interrupt the communication between the atmospheric chamber 16 and the outlet port 38. As a result, a negative pressure is applied to the above-mentioned control valve to conduct the exhaust gas recirculation, while the solenoid valve is maintained inoperative to prevent decrease of the air-fuel mixture ratio.

When the negative pressure in chamber 17 exceeds the biasing force of spring 42, the diaphragm assembly displaces rightwards, and then the inner shoulder 44 of first movable member 13 abuts against the valve member 35 to separate from the valve seat 34 against the weak biasing force of spring 33 so as to connect the atmospheric chamber 16 to the outlet port 38. As a result, the control valve is deactivated in response to the atmospheric air applied from the outlet port 38 to disconnect the exhaust gas recirculation. Simultaneously, the reed contacts 49 and 50 are engaged to each other in response to the rightward movement of magnet 58 to close the reed switch 47 so as to decrease the air-fuel mixture ratio in a conventional manner.

Figure 2:
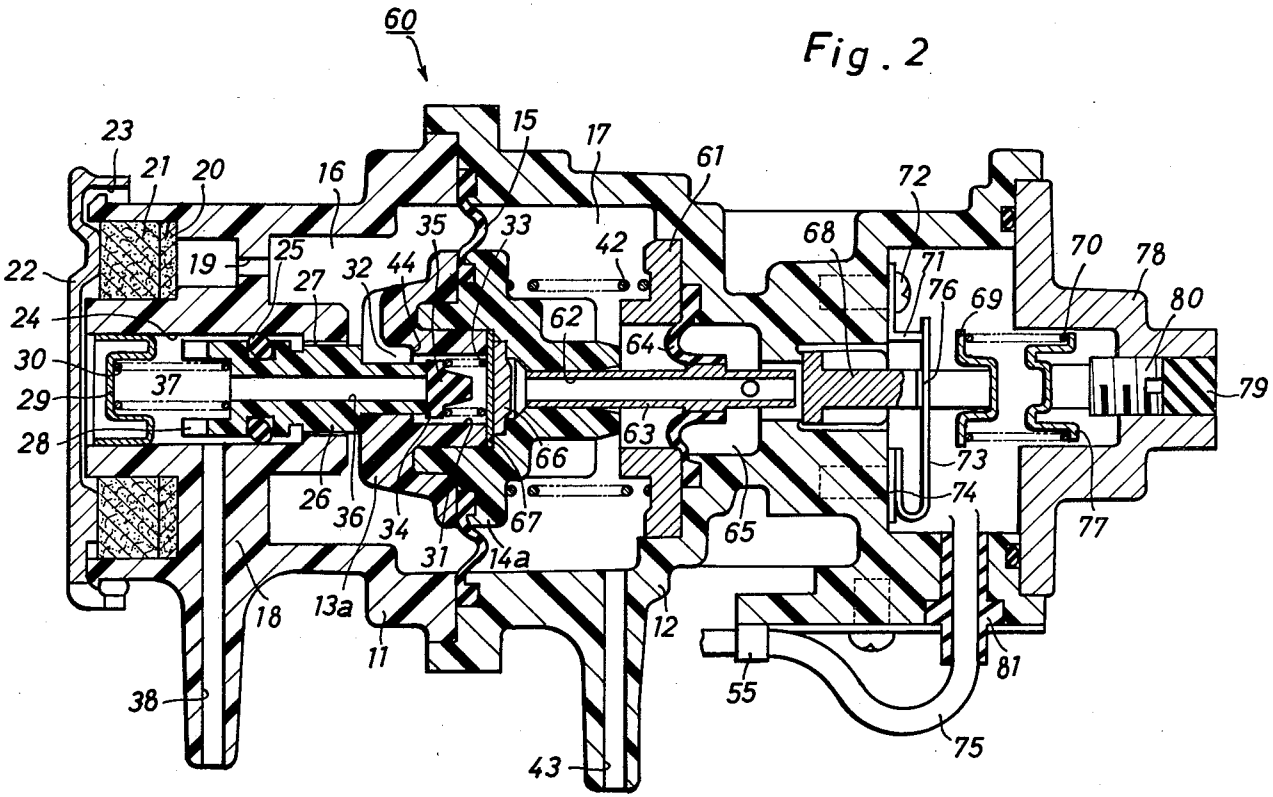
FIG. 2 is a view of an elevational cross-section of another embodiment of the present invention.

In FIG. 2, there is illustrated a modified pneumatically operated device 60 in which the same or similar component parts and portions as those in the above embodiment are indicated by the same or similar reference numerals as those in FIG. 1. In the pneumatically operated device 60, the coil spring 41 of FIG. 1 is eliminated, and the coil spring 42 of FIG. 1 is supported by a stationary plate 61 fixed to the inner wall of a modified housing section 12*a*. A tubular rod 63 is fixed at its left end to a modified movable member 14*a*, which corresponds with the movable member 14 of FIG. 1, and has an axial air passage 62 which communicates into a recessed portion 31*a* of the movable member 14*a* through a filter element 66 and an orifice plate 67. The filter element 66 is provided to prevent the entrance of moisture into the tubular rod 63. A second diaphragm member 64 is interposed and clamped at its outer periphery between the stationary plate 61 and the inner wall of housing section 12*a*, which diaphragm member 64 is fixed at its inner periphery to an intermediate portion of tubular rod 63 to form an atmospheric chamber 65 isolated from the negative pressure chamber 17.

The right end of tubular rod 63 opposes to a movable piston 68 which is slidably disposed within a stepped bore of housing section 12*a*. The piston 68 is received at its right end by a spring loaded retainer 69 and is engaged at its left end with an inner shoulder of the bore. Thus, the right end of tubular rod 63 is normally separated from the piston 68 to communicate the atmospheric chamber 65 with the recessed portion 31 of the movable member 14*a*. A fixed contact 71 is secured at 72 to the housing section 12*a*, and a movable contact 73 is also secured at 74 to the housing section 12*a*. Both the contacts 71 and 73 are connected to a source of electricity by way of lead wires. In the figure, one of the lead wires is indicated by the reference numeral 75. The lead wire 75 extends outwardly through a seal member 81 and is preferably attached at 55 to the bottom of housing section 12*a*. The movable contact 73 normally engages the fixed contact 71 by its self-reliency to provide a normally closed switch mechanism, which movable contact 73 is also engaged at 76 with the movable piston 68.

When the diaphragm assembly including members 13*a* and 14*a* is displaced rightwards, as previously described, the tubular rod 63 abuts against the piston 68 to move it rightwards, and then the movable contact 73 is separated from the fixed contact 71 in response to the rightward movement of piston 68 to open the switch mechanism. A compression coil spring 70 is engaged at its one end with the retainer 69 and at its other end with a retainer 77 which is received by a screw 80. The screw 80 is adjustably threaded into a cap member 78 of synthetic resin which is fixed to the outer end of housing section 12*a*, and a seal member 79 of silicone rubber closes the screw 80 at its adjusted position.

Having now fully set forth both structure and operation of preferred embodiments of the concept underlying the present invention, various other embodiments as well as certain variations and modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. A pneumatically operated device responsive to a signal pressure applied thereto from a source of pneumatic pressure for controlling the atmospheric air applied to a control device and for controlling an electric signal applied to an electric control circuit, said pneumatically operated device comprising:

a housing provided with a first inlet port for connection to said pneumatic pressure source, a second inlet port in open communication with the atmospheric air, and an outlet port for connection to said control device;

a diaphragm assembly assembled within said housing in a fluid tight manner to subdivide the interior of said housing into first and second chambers respectively in open communication with said first and second inlet ports, said diaphragm assembly being integrally provided with a movable member which is moved by the pressure difference between said first and second chambers;

valve means including a valve seat member adjustably threaded into said housing and a valve seat formed on an inner end portion of said valve seat member, said valve seat member having an air passage formed therein to permit the flow of atmospheric air from said second inlet port to said outlet port therethrough, and a valve member cooperating with said movable member to open and close said valve seat in response to the movement of said diaphragm assembly; and switch means arranged within said housing to be connected to said control circuit and including a pair of contacts one of which is arranged to be operated in response to the movement of said diaphragm assembly.

2. A pneumatically operated device as claimed in claim 1, wherein said housing is integrally formed with a first tubular extension located in said first chamber, and said movable member is integrally formed with a second tubular extension in surrounding relationship with said first tubular extension, and wherein said pair of contacts of said switch means are assembled within said first tubular extension, and a permanent magnet is fixed to said second tubular extension for normally engaging said contacts with each other due to the magnetic force of said magnet.

3. A pneumatically operated device as claimed in claim 1, further comprising a tubular rod fixed at its one end to said movable member and extending into said first chamber, a second diaphragm member assembled at its outer periphery within said first chamber in a fluid tight manner and fixed at its inner periphery to said tubular rod to form an atmospheric chamber in open communication with said second chamber through said tubular rod, and a spring loaded piston slidably carried on said housing and aligned with said tubular rod, and wherein one of said contacts is engaged with said piston and the other contact is fixed to said housing.

4. A pneumatically operated device as claimed in claim 1, wherein said valve means and switch means are coaxially arranged within said housing.

5. A pneumatically operated device responsive to a signal pressure applied thereto from a source of pneumatic pressure for controlling the atmospheric air applied to a control device and for controlling an electric signal applied to an electric control circuit, said pneumatically operated device comprising:

a housing provided with a first inlet port for connection to said pneumatic pressure source, a second inlet port in open communication with the atmospheric air, and an outlet port for connection to said control device;

a diaphragm assembly assembled within said housing in a fluid tight manner to subdivide the interior of said housing into first and second chambers respectively in open communication with said first and second inlet ports, said diaphragm assembly being integrally provided with a movable member which is moved by the pressure difference between said first and second chambers;

valve means including a valve seat arranged within said second chamber to permit the flow of atmospheric air from said second inlet port to said outlet port, and a valve member cooperating with said movable member to open and close said valve seat in response to the movement of said diaphragm assembly; and switch means arranged within said housing to be connected to said control circuit and including a pair of contacts one of which is arranged to be operated in response to the movement of said diaphragm assembly wherein said housing is integrally formed with a first tubular extension located in said first chamber, and said movable member is integrally formed with a second tubular extension in surrounding relationship with said first tubular extension, and wherein said pair of contacts of said switch means are assembled within said first tubular extension, and a permanent magnet is fixed to said second tubular extension for normally engaging said contacts with each other due to the magnetic force of said magnet.

6. A pneumatically operated device responsive to a signal pressure applied thereto from a source of pneumatic pressure for controlling the atmospheric air applied to a control device and for controlling an electric signal applied to an electric control circuit, said pneumatically operated device comprising:

a housing provided with a first inlet port for connection to said pneumatic pressure source, a second inlet port in open communication with the atmospheric air, and an outlet port for connection to said control device;

a diaphragm assembly assembled within said housing in a fluid tight manner to subdivide the interior of said housing into first and second chambers respectively in open communication with said first and second inlet ports, said diaphragm assembly being integrally provided with a movable member which is moved by the pressure difference between said first and second chambers;

valve means including a valve seat arranged within said second chamber to permit the flow of atmospheric air from said second inlet port to said outlet port and a valve member cooperating with said movable member to open and close said valve seat in response to the movement of said diaphragm assembly;

switch means arranged within said housing to be connected to said control circuit and including a pair of contacts one of which is arranged to be operated in response to the movement of said diaphragm assembly and a tubular rod fixed at its one end to said movable member and extending into said first chamber, a second diaphragm member assembled at its outer periphery within said first chamber in a fluid tight manner and fixed at its inner periphery to said tubular rod to form an atmospheric chamber in open communication with said second chamber through said tubular rod, and a spring loaded piston slidably carried on said housing and aligned with said tubular rod, and wherein one of said contacts is engaged with said piston and the other contact is fixed to said housing.

7. A pneumatically operated device responsive to a signal pressure applied thereto from a source of pneumatic pressure for controlling the atmospheric air applied to a control device and for controlling an electric signal applied to an electric control circuit, said pneumatically operated device comprising:

a housing provided with a first inlet port for connection to said pneumatic pressure source, a second inlet port in open communication with the atmospheric air, and an outlet port for connection to said control device, said housing being integrally formed with a first tubular extension located therein;

a diaphragm assembly assembled within said housing in a fluid tight manner to subdivide the interior of said housing into first and second chambers respectively in open communication with said first and second inlet ports, said diaphragm assembly being arranged to be moved by the pressure difference between said first and second chambers and being integrally provided with a movable member;

valve means including a valve seat arranged within said second chamber to permit the flow of atmospheric air from said second inlet port to said outlet port, and a valve member cooperating with said movable member to open and close said valve seat in response to the movement of said diaphragm assembly; and switch means arranged within said first tubular extension to be connected to said control circuit and including a pair of contacts one of which is arranged to be operated in response to the movement of said diaphragm assembly;

and wherein said movable member is integrally formed with a second tubular extension in surrounding relationship with said first tubular extension within said first chamber, and wherein said switch means includes a permanent magnet fixed to said second tubular extension for normally engaging said contacts with each other due to the magnetic force of said magnet.

8. A pneumatically operated device as claimed in claim 7, wherein said first tubular extension of said housing is coaxially arranged with said valve means, and said first inlet port and said outlet port are radially provided on said housing.

9. A pneumatically operated device responsive to a signal pressure applied thereto from a source of pneumatic pressure for controlling the atmospheric air applied to a control device and for controlling an electric signal applied to an electric control circuit, said pneumatically operated device comprising:

a housing provided with a first inlet port for connection to said pneumatic pressure source, a second inlet port in open communication with the atmospheric air, and an outlet port for connection to said control device;

a diaphragm assembly assembled within said housing in a flight tight manner to subdivide the interior of said housing into first and second chambers respectively in open communication with said first and second inlet ports, said diaphragm assembly being arranged to be moved by the pressure difference between said first and second chambers and being integrally provided with a movable member;

valve means including a valve seat arranged within said second chamber to permit the flow of atmospheric air from said second inlet port to said outlet port, and a valve member cooperating with said movable member to open and close said valve seat in response to the movement of said diaphragm assembly;

an extension rod fixed at its one end to said movable member and extending into said first chamber;

a second diaphragm member assembled at its outer periphery within said first chamber in a fluid tight manner and fixed at its inner periphery to said extension rod to form a space isolated from said first chamber; and switch means arranged within said space to be connected to said control circuit and including a pair of contacts one of which is arranged to be operated by said extension rod.

10. A pneumatically operated device as claimed in claim 9, further comprising a spring loaded piston slidably carried on said housing and aligned with said extension rod, and wherein one of said contacts is engaged with said piston and the other contact is fixed to said housing.

11. A pneumatically operated device as claimed in claim 9 or 10, wherein said first inlet port and said outlet port are radially provided on said housing, and said valve means and said extension rod are coaxially arranged.

* * * * *